US008479930B1

(12) United States Patent
Cohen

(10) Patent No.: US 8,479,930 B1
(45) Date of Patent: Jul. 9, 2013

(54) ORGANIZING SYSTEM FOR WEIGHTS AND ACCESSORIES

(76) Inventor: Joshua C. Cohen, Largo, FL (US)

( * ) Notice: Subject to any disclaimer, the term of this patent is extended or adjusted under 35 U.S.C. 154(b) by 0 days.

(21) Appl. No.: 13/348,957

(22) Filed: Jan. 12, 2012

(51) Int. Cl.
*A47B 81/00* (2006.01)

(52) U.S. Cl.
USPC ..... 211/85.7; 211/13.1

(58) Field of Classification Search
USPC .... 211/85.7, 13.1, 16, 107, 133.4; 248/122.1; 482/38, 148
See application file for complete search history.

(56) References Cited

U.S. PATENT DOCUMENTS

| | | | | |
|---|---|---|---|---|
| 670,144 | A * | 3/1901 | Bond | 248/125.3 |
| 3,908,853 | A * | 9/1975 | Keesling | 220/475 |
| 4,953,223 | A * | 8/1990 | Householder | 381/387 |
| 5,402,595 | A * | 4/1995 | Tamllos | 42/94 |
| 5,423,509 | A | 6/1995 | LaPorte et al. | |
| 5,435,799 | A | 7/1995 | Lundin | |
| 5,819,720 | A * | 10/1998 | Schubert | 126/41 R |
| 5,862,924 | A * | 1/1999 | Dumont | 211/85.7 |
| 6,129,220 | A | 10/2000 | Decossas | |
| 6,357,616 | B1 | 3/2002 | Harris et al. | |
| D528,612 | S | 9/2006 | Black | |
| D585,668 | S | 2/2009 | Fagen | |
| 7,575,095 | B2 * | 8/2009 | An et al. | 181/199 |
| 2002/0030025 | A1 * | 3/2002 | Sipe | 211/4 |
| 2005/0039377 | A1 * | 2/2005 | Clary | 43/54.1 |
| 2007/0170331 | A1 * | 7/2007 | Prater | 248/311.2 |
| 2007/0235400 | A1 * | 10/2007 | Wald | 211/85.7 |
| 2007/0252919 | A1 * | 11/2007 | McGreevy | 348/825 |
| 2011/0024374 | A1 * | 2/2011 | Brown et al. | 211/85.7 |

* cited by examiner

*Primary Examiner* — Korie H Chan

(57) ABSTRACT

An organizing system for weights and accessories having a base with a support bar extending upwardly from the base, a container with a lid on a top end of the support bar which has an inner cavity adapted to hold items, a weight rack shaft extending outwardly from a side of the support bar which is adapted to hold a weight, a cup holder and a hanger on the support bar, a speaker in the support bar, and either a universal serial bus (USB) port or a RCA connection port in the support bar operatively connected to the speaker.

7 Claims, 3 Drawing Sheets

ORGANIZING SYSTEM FOR WEIGHTS AND ACCESSORIES

FIELD OF THE INVENTION

The present invention is directed to a weight holding system for gyms, more particularly to an organizing system for organizing weights and personal accessories.

BACKGROUND OF THE INVENTION

Many individuals bring items such as drinks, music players, keys, towels, and other items with them when they work out. Such items can get knocked over, damaged, or become dirty when placed on the floor. The present invention features an organizing system for weights and accessories. The system of the present invention stores weights and provides convenient places for storing beverages, keys, towels, and the like. The system also features a speaker system and a connection port allowing a user to hook up a music player.

SUMMARY

The present invention features an organizing system for weights and accessories. In some embodiments, the organizing system for weights and accessories comprises a base; a support bar extending upwardly from the base; a container disposed on a top end of the support bar, the container has an inner cavity adapted to hold items, the container comprises a lid, the lid can move between an open position and a closed position respectively allowing and preventing access to the inner cavity of the container; a weight rack shaft extending outwardly from a side of the support bar, the weight rack shaft is adapted to hold a weight; a cup holder disposed on the support bar; a hanger disposed on the support bar; a speaker disposed in the support bar; and either a universal serial bus (USB) port or a RCA connection port disposed in the support bar, wherein the USB port or the RCA connection port is operatively connected to the speaker.

In some embodiments, the base is H-shaped, round, oval, or rectangular. In some embodiments, the container comprises a lock for securing the lid in the closed position. In some embodiments, the lid is pivotally attached to the container via a hinge. In some embodiments, the system comprises two weight rack shafts. In some embodiments, the system comprises four weight rack shafts. In some embodiments, the hanger is positioned opposite the cup holder.

In some embodiments, the system further comprises a footing disposed on a bottom surface of the base to help prevent the base from slipping on a ground surface.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Referring now to FIGS. 1-5, the present invention features an organizing system 100 for weights and accessories. The system 100 of the present invention stores weights and provides convenient places for storing beverages, keys, towels, and the like.

Figure 1:
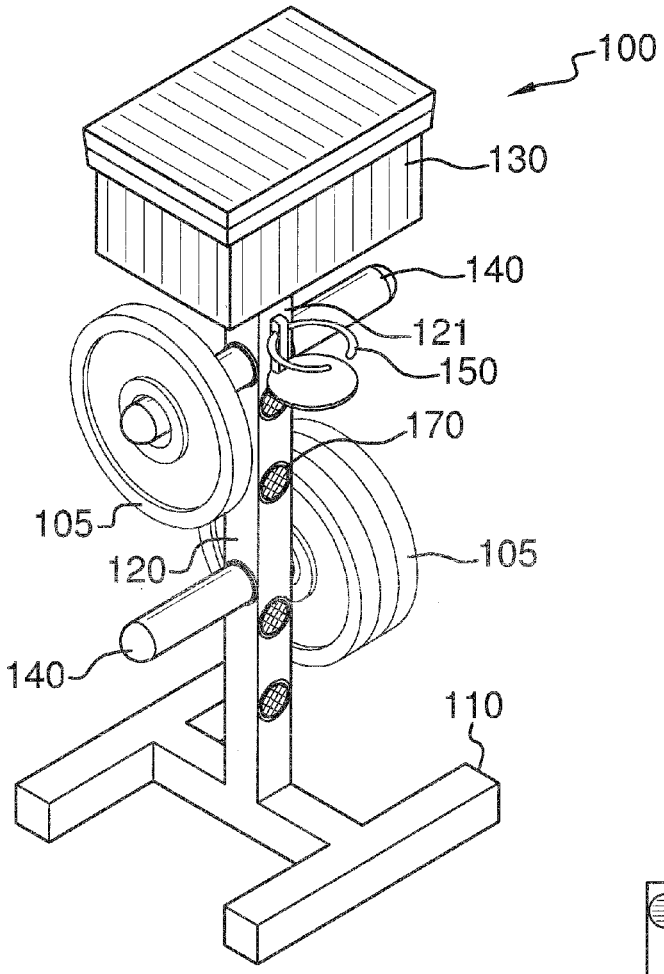
FIG. 1 is a perspective view of the system of the present invention.

The system 100 comprises a base 110. The base 110 is adapted to be placed on a ground surface (e.g., floor of a gym or other location). The base 110 may be constructed in a variety of shapes and sizes. For example, as shown in FIG. 1, the base 110 may be H-shaped; however, the base 110 is not limited to this shape. For example, in some embodiments, the base 110 is round, oval, rectangular, etc.

The system 100 further comprises a support bar 120 extending upwardly, e.g., vertically, from the base 110. In some embodiments, the support bar 120 is perpendicular to the base 110 (e.g., as shown in FIG. 1). In some embodiments, the support bar 120 is at an angle with respect to the base 110.

Disposed on the top end 121 of the support bar 120 is a container 130 having an inner cavity adapted to hold items such as jewelry, phones, keys, sunglasses, and other personal items. The container 130 comprises a lid 136, which can move between an open position and a closed position respectively allowing and preventing access to the inner cavity of the container 130. In some embodiments, the container 130 comprises a locking means (e.g., a snap mechanism) for securing the lid 136 in the closed position. In some embodiments, the lid 136 is pivotally attached to the container 130 via a hinge 134.

Extending outwardly from the support bar 120 is a weight rack shaft 140 (or multiple weight rack shafts 140). Weight rack shafts are well known to one of ordinary skill in the art. Weight rack shafts are adapted to hold weights 105 (e.g. see FIG. 1). In some embodiments, the system 100 comprises two weight rack shafts 140. In some embodiments, the system 100 comprises three weight rack shafts 140. In some embodiments, the system 100 comprises four weight rack shafts 140. In some embodiments, the system 100 comprises more than four weight rack shafts 140. The weight rack shafts 140 may be arranged in any appropriate arrangement.

Disposed on the support bar 120, e.g., near the top end 121 of the support bar 120, is a cup holder 150. The cup holder 150 is adapted to hold a cup or bottle. Cup holders are well known to one of ordinary skill in the art. In some embodiments, a hanger 158 (e.g., a hook) is disposed on the support bar 120, e.g., near the top end 121. In some embodiments, the hanger 158 is positioned opposite the cup holder 150 (e.g., see FIG. 4).

Figure 2:
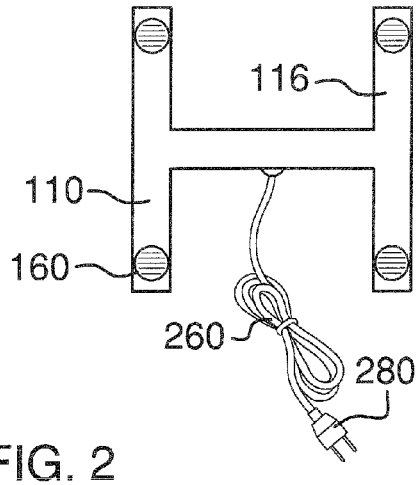
FIG. 2 is a bottom view of the system of the present invention.
Figure 3:
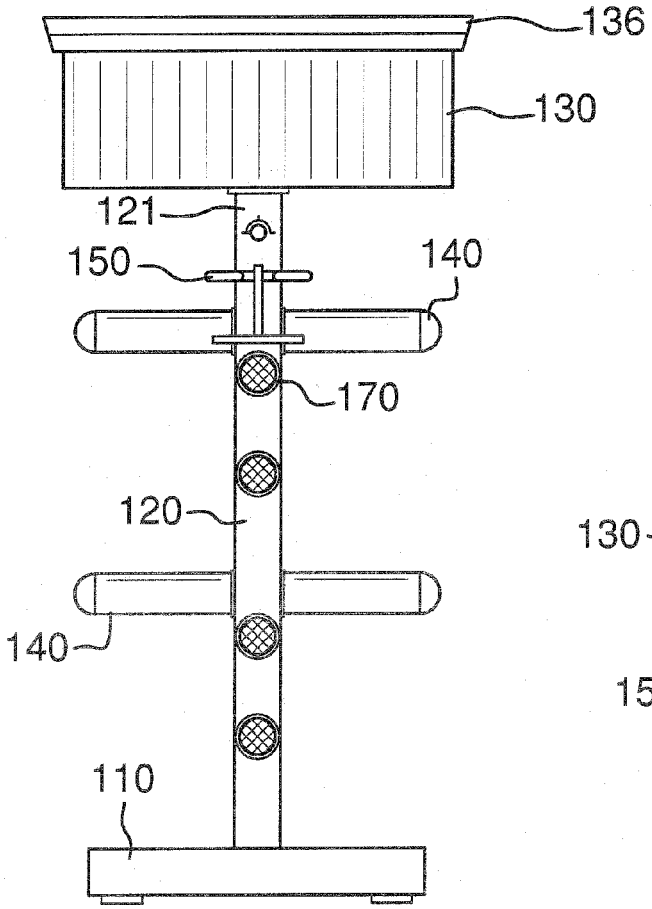
FIG. 3 is a front view of the system of the present invention.
Figure 4:
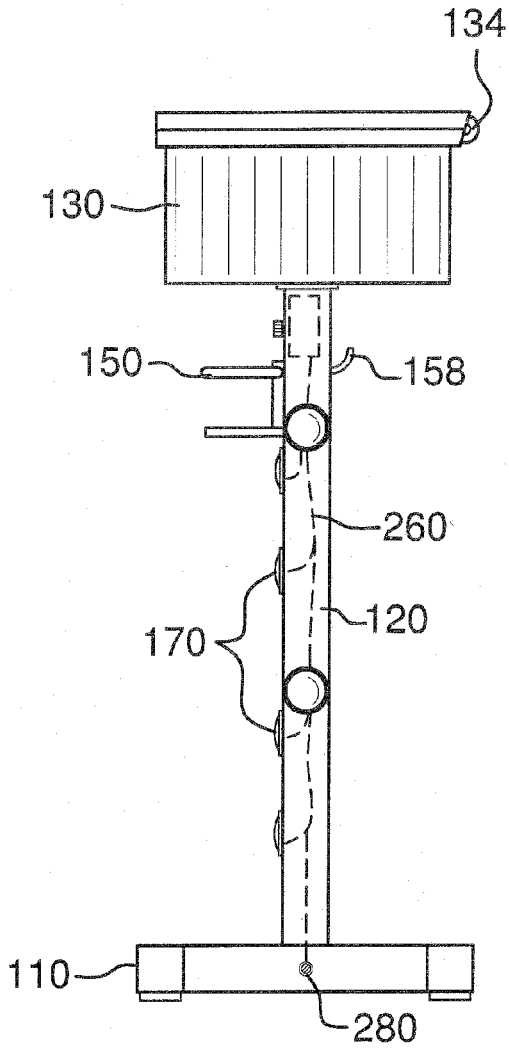
FIG. 4 is a side view of the system of the present invention.
Figure 5:
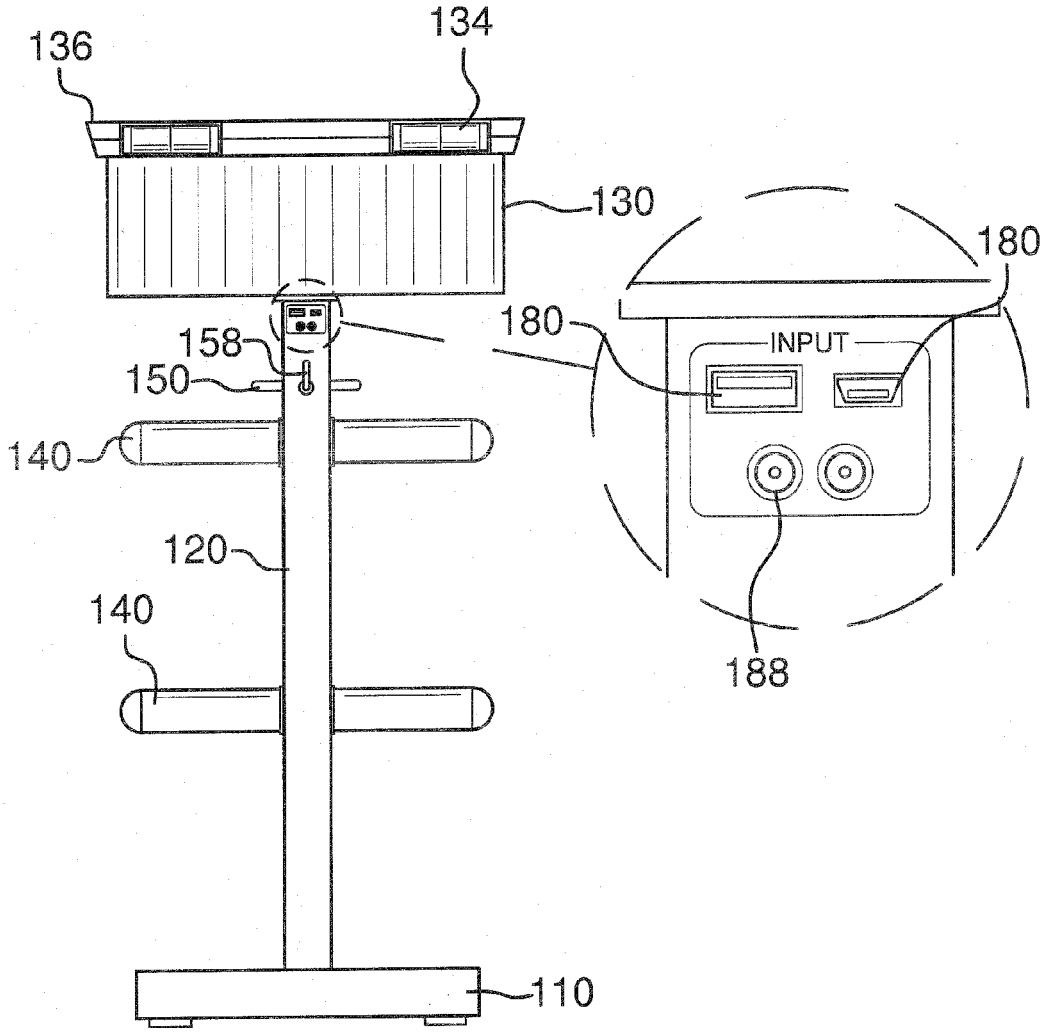
FIG. 5 is a back view of the system of the present invention.

As shown in FIG. 2, in some embodiments, one or more footings 160 are disposed on the bottom surface 116 of the base 110. The footings 160 help prevent the base 110 from slipping on the ground surface.

Disposed in the support bar 120 (e.g., near the top end 121) is a universal serial bus (USB) port 180. In some embodiments, a RCA connection port 188 (e.g., phono connector, cinch connector) is disposed in the support bar 120 (e.g., near the top end 121). USB ports and RCA connection ports are well known to one of ordinary skill in the art. In some embodiments, the USB port 180 and RCA connection port 188 are each disposed on a control panel, which is disposed on the support bar 120 (e.g., the USB port 180 and RCA connection port 188 are clustered together).

One or more speakers 170 are disposed in the support bar 120, for example along the length of the support bar 120 (e.g., from the top end 121 to the bottom end 122). The speakers 170 are adapted to emit sounds (e.g., music). Speakers are well known to one of ordinary skill in the art. The speakers 170 are each operatively connected to the RCA connection port 188 and the USB port 180 (e.g., via wiring 260).

In some embodiments, the system 100 comprises a power source. In some embodiments, the power source is a battery. In some embodiments, the system 100 can be connected to an electrical outlet via a plug 280.

In some embodiments, the system 100 further comprises a volume control button for controlling the volume of the music played by the speakers 170.

The disclosures of the following U.S. patents are incorporated in their entirety by reference herein: U.S. Pat. No. 5,423,509; U.S. Pat. No. 5,435,799; U.S. Pat. No. 6,129,220; U.S. Pat. No. 6,357,616; U.S. Design Pat. No. D528612; U.S. Design Pat. No. D585668.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The reference numbers recited in the below claims are solely for ease of examination of this patent application, and are exemplary, and are not intended in any way to limit the scope of the claims to the particular features having the corresponding reference numbers in the drawings.

What is claimed is:

1. An organizing system (100) for weights and accessories, said organizing system (100) comprising:

(a) a planar base (110);

(b) a support bar (120) extending upwardly from the center of the base (110);

(c) a container (130) disposed on a top end (121) of the support bar (120), the container (130) has an inner cavity adapted to hold items, the container comprises a lid (136), wherein the lid (136) is pivotally attached to the container (130) via a hinge (134), wherein the lid (136) can move between an open position and a closed position respectively allowing and preventing access to the inner cavity of the container (130), wherein the container (130) comprises a lock (138) for securing the lid (136) in the closed position;

(d) a weight rack shaft (140) extending outwardly from a side (123) of the support bar (120), the weight rack shaft (140) is adapted to hold a weight (105);

(e) a cup holder (150) disposed on the support bar (120);

(f) a hanger (158) disposed on the support bar (120);

(g) a speaker (170) disposed in the support bar (120); and (h) either a universal serial bus (USB) port (180) or a RCA connection port (188) disposed in the support bar (120), wherein the USB port (180) or the RCA connection port (188) is operatively connected to the speaker (170).

2. The system (100) of claim 1, wherein the base (110) is H-shaped, round, oval, or rectangular.

3. The system (100) of claim 1, wherein the system (100) comprises two weight rack shafts (140).

4. The system (100) of claim 1, wherein the system (100) comprises four weight rack shafts (140).

5. The system (100) of claim 1, wherein the hanger (158) is positioned opposite the cup holder (150).

6. The system (100) of claim 1 further comprising a footing (160) disposed on a bottom surface (116) of the base (110) to help prevent the base (110) from slipping on a ground surface.

7. An organizing system (100) for weights and accessories, said organizing system (100) consisting of:

(a) a planar base (110);

(b) a support bar (120) extending upwardly from the center of the base (110);

(c) a container (130) disposed on a top end (121) of the support bar (120), the container (130) has an inner cavity adapted to hold items, the container consists of a lid (136), wherein the lid (136) is pivotally attached to the container (130) via a hinge (134), wherein the lid (136) can move between an open position and a closed position respectively allowing and preventing access to the inner cavity of the container (130), wherein the container (130) consists of a lock (138) for securing the lid (136) in the closed position;

(d) a weight rack shaft (140) extending outwardly from a side (123) of the support bar (120), the weight rack shaft (140) is adapted to hold a weight (105);

(e) a cup holder (150) disposed on the support bar (120);

(f) a hanger (158) disposed on the support bar (120);

(g) a speaker (170) disposed in the support bar (120); and (h) either a universal serial bus (USB) port (180) or a RCA connection port (188) disposed in the support bar (120), wherein the USB port (180) or the RCA connection port (188) is operatively connected to the speaker (170).

* * * * *